US006786855B2

(12) United States Patent
Prichard

(10) Patent No.: US 6,786,855 B2
(45) Date of Patent: Sep. 7, 2004

(54) HIP ROTATION TRAINING DEVICE

(76) Inventor: Robert Prichard, 203 Golden Hind Passage, Corte Madera, CA (US) 94925

( * ) Notice: Subject to any disclaimer, the term of this patent is extended or adjusted under 35 U.S.C. 154(b) by 0 days.

(21) Appl. No.: 10/076,734

(22) Filed: Feb. 15, 2002

(65) Prior Publication Data

US 2003/0158021 A1 Aug. 21, 2003

(51) Int. Cl.[7] ..... A63B 21/045
(52) U.S. Cl. ..... 482/127
(58) Field of Search ..... 473/458, 422, 473/216, 215; 482/127, 121, 122, 123, 53, 87, 73, 112, 124, 125

(56) References Cited

U.S. PATENT DOCUMENTS 1,531,960 A * 11/1925 Ungar
3,415,524 A * 12/1968 Vickers
4,318,546 A * 3/1982 Chen
4,632,393 A * 12/1986 Van Noord
5,688,212 A * 11/1997 Walker ..... 482/127
5,924,933 A * 7/1999 Pacheco ..... 472/216
6,120,418 A * 9/2000 Plough ..... 482/69
6,248,047 B1 * 6/2001 Abdo ..... 482/130
6,402,667 B1 * 6/2002 Dahn ..... 482/121

* cited by examiner

*Primary Examiner*—Jerome W. Donnelly

(57) ABSTRACT

Hip Rotation Training Device with a base plate, a torsion resisting element such as a torsion spring, a torsion spring attachment rod, an inner vertical support tube, a tube support socket, an outer vertical support tube and a hip retaining assembly. The tube support socket is fixedly attached to the base plate. The torsion spring is fixedly attached to the bottom of the inner vertical support tube. The spring attachment rod is fixedly attached to bottom of said torsion spring, said spring attachment rod slidalbly attached at its opposite end to said tube support socket and held in place by a cross pin. The outer support tube slidably placed over said inner vertical support tube, said outer tube having a plurality of vertically spaced apertures and said first having a plurality of apertures in line with each other so that a person can adjust the height of said outer support tube by sliding it up or down with relation to said inner support tube and when the proper height is found, piercing through the apertures in both the inner and outer support tubes by means of a cross pin. The outer support tube is fixedly terminated at its top portion by said hip retaining assembly. The hip retaining assembly comprised of a central horizontally disposed metal bar, said bar having a hinged curved plate member at its left and right ends, said curved plates each having a flexible strap member, said strap having a standard attachment clasp.

3 Claims, 5 Drawing Sheets

HIP ROTATION TRAINING DEVICE

BACKGROUND OF THE INVENTION

This invention relates generally to the field of exercise devices, and more particularly to a hip rotation training device.

Many sports activities, whether throwing a ball, discus, javelin, shot put or punches; passing a football, or swinging a bat, racquet, or golf club derive their power from the rotation of the hips. Recent research shows that even swimmers derive their power from the rotation of their hips. Until now, there has not been any reliable means of improving the strength or speed of this critical motion.

Other exercise devices exist that are designed to improve the muscle tone and flexibility of various muscle groups however, none of the existing devices adequately provide a resistance workout to strengthen and increase the speed of the hip rotation motion that is so important to many sport activities.

SUMMARY OF THE INVENTION

The primary object of the invention is to provide a hip rotation training device that helps a person increase the strength and speed of the rotation motion of his or her hips for improving performance in sports activities.

Another object of the invention is to provide a hip rotation training device that allows a person to bend forward or sideways while practicing the rotation motion.

Another object of the invention is to provide a hip rotation training device that allows the user to adjust the height of the hip retaining strap to the height of his or her hips.

A further object of the invention is to provide a hip rotation training device that allows the user to practice a sport such as baseball, tennis and the like while strapped into the present hip training device.

Other objects and advantages of the present invention will become apparent from the following descriptions, taken in connection with the accompanying drawings, wherein, by way of illustration and example, an embodiment of the present invention is disclosed.

Hip Rotation Training Device comprising: a base plate, a torsion resisting element such as a torsion spring, a torsion spring attachment rod, an inner vertical support tube, a tube support socket, an outer vertical support tube, a hip retaining assembly, said tube support socket fixedly attached to said base plate, said torsion spring fixedly attached to the bottom of said inner vertical support tube, said spring attachment rod fixedly attached to bottom of said torsion spring, said spring attachment rod slidalbly attached at its opposite end to said tube support socket and held in place by a cross pin, said outer support tube slidably placed over said inner vertical support tube, said outer tube having a plurality of vertically spaced apertures and said first having a plurality of apertures in line with each other so that a person can adjust the height of said outer support tube by sliding it up or down with relation to said inner support tube and when the proper height is found, piercing through the apertures in both the inner and outer support tubes by means of a cross pin, said outer support tube fixedly terminating at its top portion by said hip retaining assembly, said hip retaining assembly comprised of a central horizontally disposed metal bar, said bar having a hinged curved plate member at its left and right ends, said curved plates each having a flexible strap member attached to their free ends, said strap having a standard attachment clasp, and said clasp being adjustable along said strap similar to that of a vehicle seat belt so that said strap can adjust to users of wider or narrower hip dimensions.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
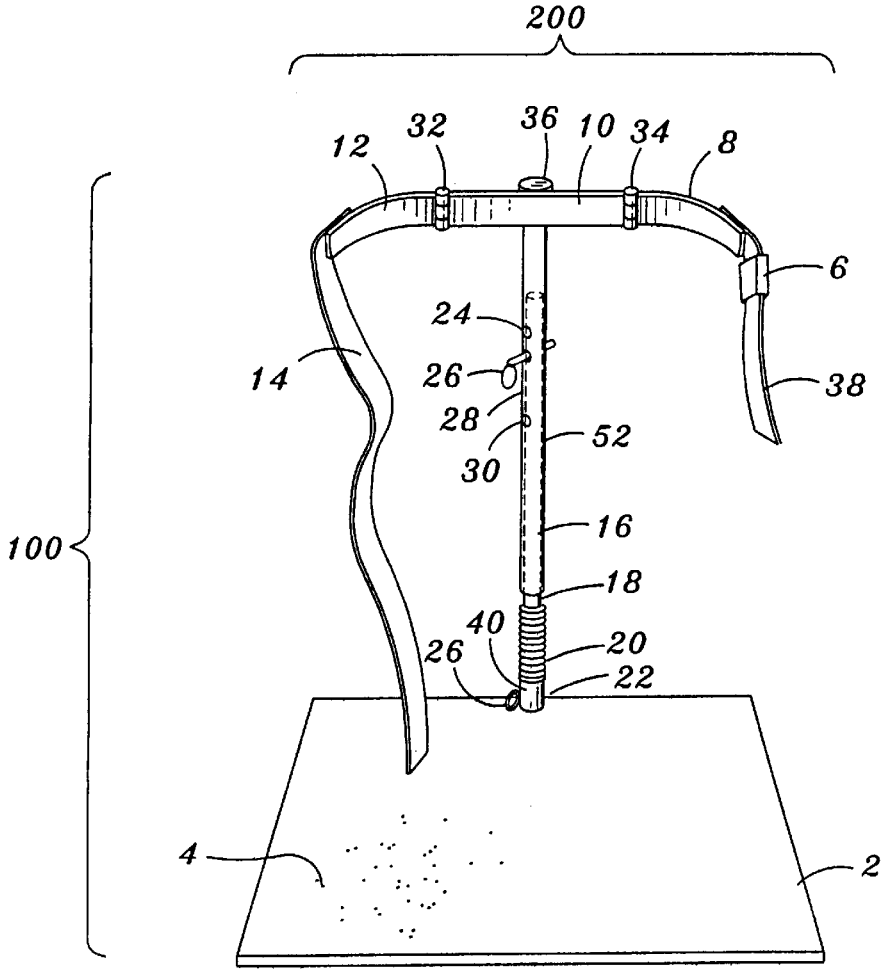
FIG. 1 is is a perspective view of the hip rotation training device of the present invention.
Figure 2:
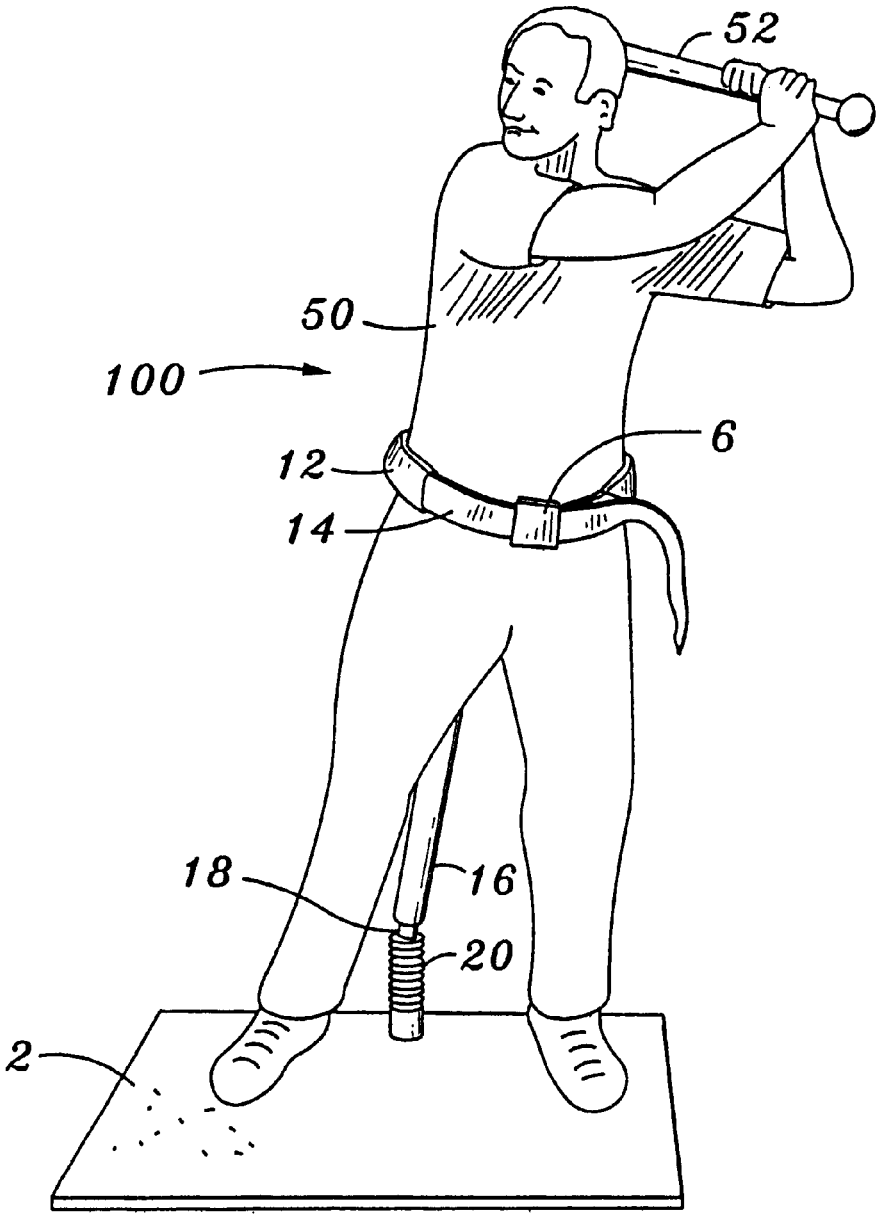
FIG. 2 is a front perspective view showing a person strapped into the present invention.
Figure 3:
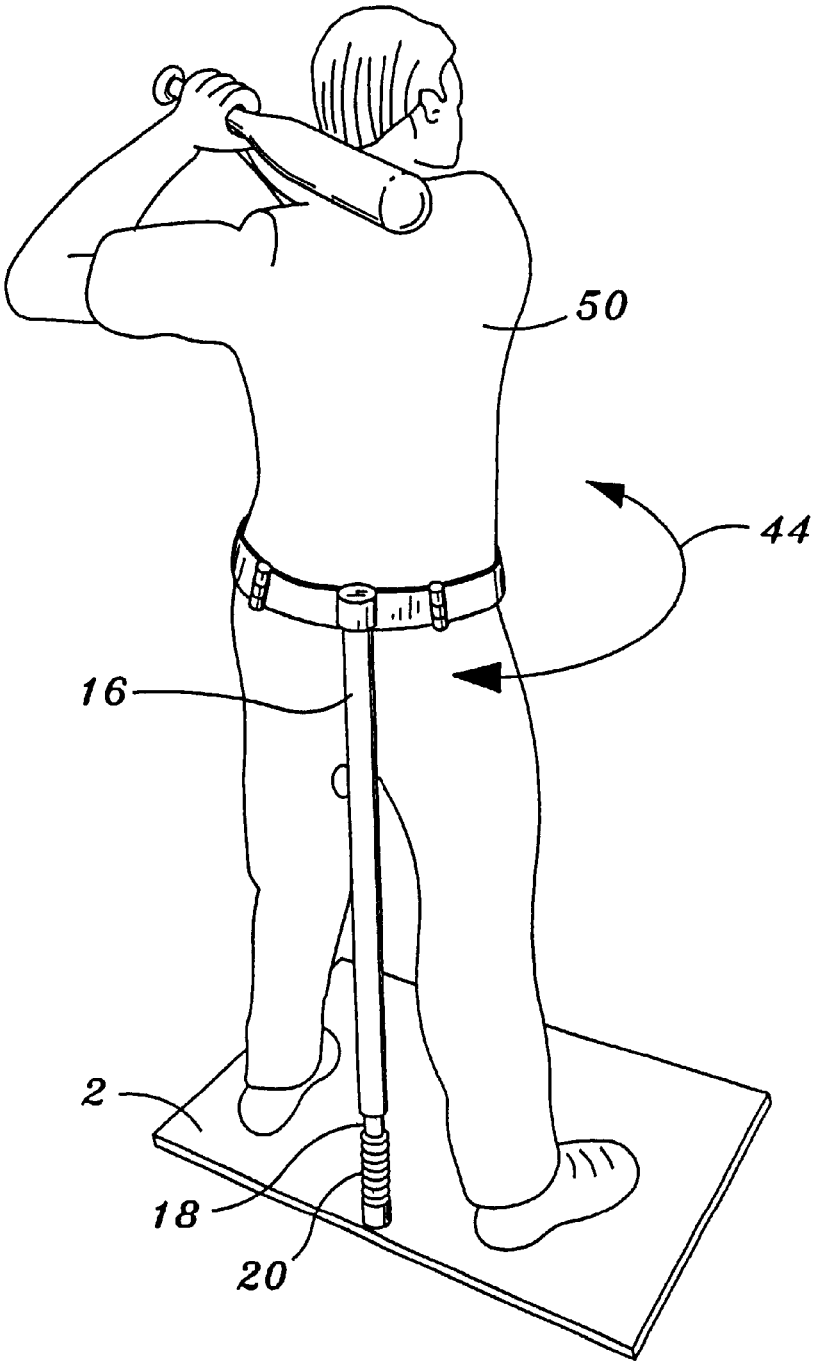
FIG. 3 is a rear perspective view of a person strapped into the present invention.
Figure 4:
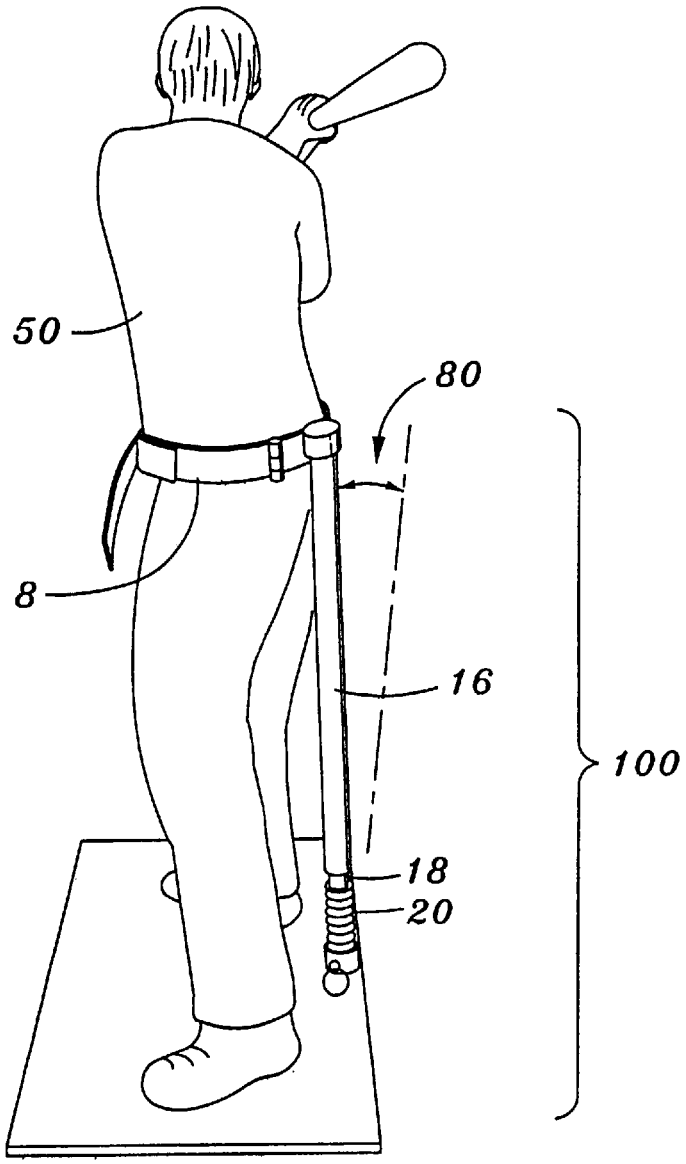
FIG. 4 is a side perspective view of a person using the present invention.
Figure 5:
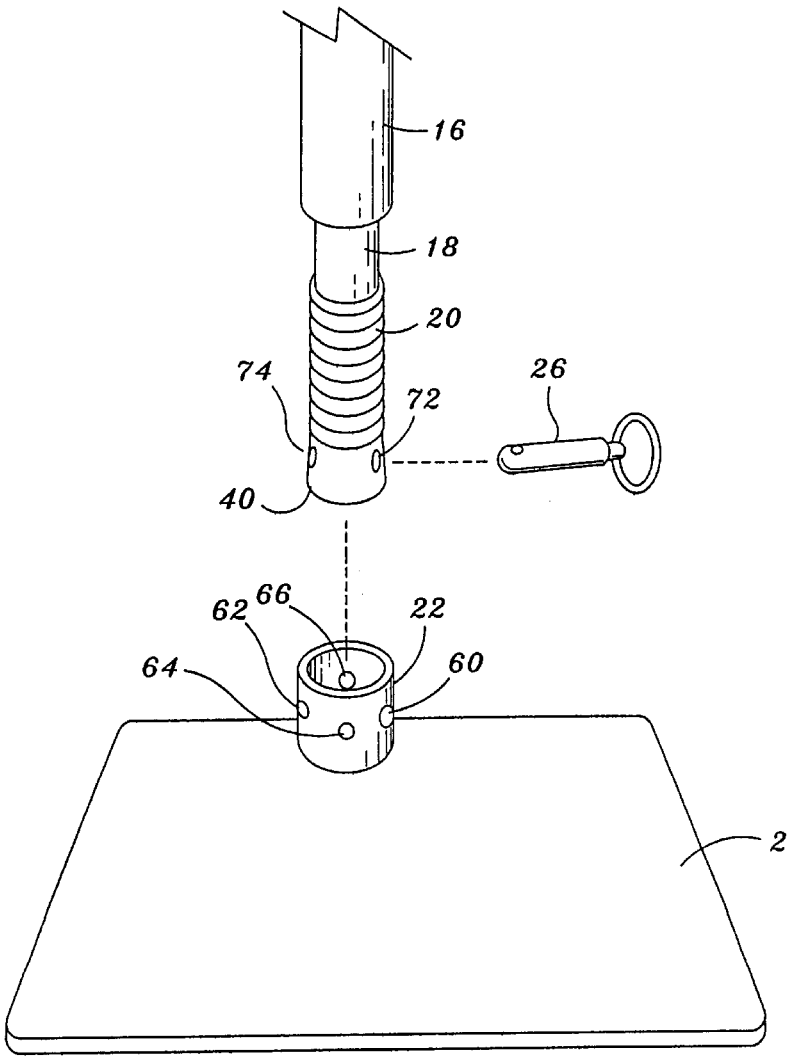
FIG. 5 is a partial exploded view of the base plate and vertical support tube.

Referring now to FIG. 1 we see a perspective view of the hip training device of the present invention 100. The device is comprised of a base plate 2 having an anti slip material attached 4 attached to its top surface, a tube holder 22, an inner vertical tube 18 shown inside outer tube 16 by dotted line 52. Inner support tube 18 is terminated at its top end in a hip retainer attachment cap 36 and at its bottom end in torsion spring 20 and below that a spring attachment rod as shown by dotted line 40. The present invention is also comprised of outer support tube 16 and a hip retaining assembly 200. Outer support tube 16 can be raised or lowered by pulling out cross pin 26 and raising or lowering tube 16 then re-pinning cross pin 26 into one of the other vertically spaced apertures 24, 28, 30 located on outer tube 16. Hip Retaining assembly 200 is comprised of a center bar 10 and a pair of curved bars 8, 12 that are attached to the center bar by hinges 32, 34. Curved bars 32, 34 have flexible straps 14, 38 attached to their free ends. A clasp 6 is slidably attached to strap 38 and works in a similar fashion to a standard seat belt clasp found in most current vehicles. The inner surface of the cross memeber 10 and curved bars 8, 12 have standard resilient padding fixidly attached. The top portion 36 of outer tube 16 is fixedly attached to the center bar 10. Curved bars 8, 12 are hinged and capable of wrapping around the user's hips. Straps 14, 38 when snapped together by clasp 6 complete the retaining means for securely holding the user's hips. Torsion spring 20 is a heavy duty extension spring that is made of steel with an outside diameter of two inches, a wire diameter of two hundred and seven thousandths of an inch and an overall length of six inches. This type of spring performs multiple tasks. First it acts an a torsion spring so that when the user twists to the left or right, he or she experiences a resistance in the hip area. This effect is shown clearly in FIG. 3 as represented by radial line 44. Secondly, the spring 22 allows the vertical support tube 16 to be bent to an angle other than ninety degrees to base plate 2. This effect is helpful when a person needs to lean forward , as shown in FIG. 4 angle 80, where the user has leaned into a pitched ball. Note that the user can actually practice hitting a ball while strapped into the present invention 100. FIG. 2 shows a person 50 using the hip rotation training device 100 of the present invention. In this illustration the user is practicing the swing of a baseball bat. However, it should be noted that the present invention 100 can be used to help a person improve in sports like tennis, football, golf and most other sports that require strong and speedy hip rotation. In the case of baseball, tennis and golf and the like, the user can actually practice the motion required in the sport while strapped into the present invention 100. FIG. 2 shows the user ready to swing a baseball bat 52. Straps 14, 38 are held together by clasp 6. When the user twists his or her hips in the process of swinging, he or she encounters the resistance of torsion spring 18. This resistance helps the user build up the muscles associated with hip rotation. Additionally, the torsion spring can be pre-loaded in one direction or another. The pre-loading is accomplished, as shown in FIG. 5, by removing cross pin 40 from the apertures 60 62 in vertical tube support socket 22. Then the user rotates vertical tube 16 so that apertures 72, 74 are lined up with apertures 64, 66 in the tube support socket 60. The entire hip retaining assembly is now ninety degrees offset from the view in FIG. 1. As the individual rotates his hips away from the ball, in this embodiment, potential energy is built up in the device, which will then accelerate the rotation of the hips beyond what the individual can do unaided. As the user practices with the device in this mode, he will gradually become used to moving his hips at faster and faster speeds. This will help the individual to not only increase the strength of hip rotation, but also the speed and acceleration. Research has shown, for instance, that swimmers who increase the speed of their hip rotation can double the peak force their hands apply to the water. Additionally, golfers and baseball batters can dramatically increase the length of their drives.

Although the present embodiment describes the use of a torsion spring as a resistive element, other resistance elements may be substituted such as pneumatic or hydraulic cylinders, electromagnetic resistance or other types of elastomers such as nylon or high durometer rubber.

As the above descriptions and illustrations show, the hip rotation training device of the present invention is novel in that it is adjustable for all users, is portable, inexpensive to manufacture and provides a unique solution to the problem of improving the strength and speed of hip rotation which is an essential movement that is associated with most sports activities.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Hip Rotation Training Device comprising:

a base plate;

a torsion spring;

a torsion spring attachment rod;

an inner vertical support tube;

a tube support socket;

an outer vertical support tube;

a hip retaining assembly;

said tube support socket fixedly attached to said base plate;

said torsion spring fixedly attached to the bottom of said inner vertical support tube;

said spring attachment rod fixedly attached to bottom of said torsion spring;

said spring attachment rod slidalbly attached at its opposite end to said tube support socket and held in place by a cross pin;

said outer support tube slidably placed over said inner vertical support tube;

said outer tube having a plurality of vertically spaced apertures in line with each other so that a person can adjust the height of said outer support tube by sliding it up or down with relation to said inner support tube and when the proper height is found, piercing through the apertures in both the inner and outer support tubes by means of a cross pin;

said outer support tube attached at its top portion to by said hip retaining assembly;

said hip retaining assembly comprised of a central horizontally disposed bar, said bar having a hinged curved plate member at its left and right ends;

said curved plates each having a flexible strap member attached to their free ends;

said strap having a attachment clasp; and said clasp being adjustable along said strap to allow said strap can adjust to users of wider or narrower hip dimensions.

2. Hip Rotation Training Device as claimed in claim 1 wherein said outer vertical support tube can be rotated ninety degrees so that said hip retaining assembly can be turned ninety degrees or other off angle thereby allowing the user to pre-load said torsion spring when standing in the normal position so that the user can experience rapid hip rotation generated by said pre-loaded torsion spring.

3. Hip Rotation Training Device as claimed in claim 1 wherein said base plate has an anti slip material applied to its top surface.

* * * * *